United States Patent [19]

Potter

[11] Patent Number: 4,896,645

[45] Date of Patent: Jan. 30, 1990

[54] FUEL PUMPING APPARATUS

[75] Inventor: James C. Potter, London, England

[73] Assignee: Lucas Industries public limited company, Birmingham, England

[21] Appl. No.: 389,487

[22] Filed: Aug. 4, 1989

[30] Foreign Application Priority Data

Oct. 11, 1988 [GB] United Kingdom ..... 8823846

[51] Int. Cl.[4] ..... F02M 39/00; F02B 19/02

[52] U.S. Cl. ..... 123/506; 123/450; 123/447; 417/462

[58] Field of Search ..... 123/506, 357–359, 123/450, 447; 417/462, 294

[56] References Cited

U.S. PATENT DOCUMENTS

| | | | |
|---|---|---|---|
| 2,674,236 | 4/1954 | Humber | 417/294 |
| 4,083,345 | 4/1978 | Davis | 123/450 |
| 4,173,959 | 11/1979 | Sosnowski | 417/462 |
| 4,376,432 | 3/1983 | Davis | 123/506 |
| 4,498,442 | 2/1985 | Tissot | 123/447 |
| 4,530,324 | 7/1985 | Tanaka | 123/450 |
| 4,531,488 | 7/1985 | Kawamura | 417/462 |
| 4,531,491 | 7/1985 | Iiyama | 123/357 |
| 4,550,702 | 11/1985 | Djordjevic | 123/450 |
| 4,552,117 | 11/1985 | Djordjevic | 123/506 |
| 4,601,274 | 7/1986 | Seilly | 417/462 |

FOREIGN PATENT DOCUMENTS

| | | | |
|---|---|---|---|
| 2630385 | 5/1977 | Fed. Rep. of Germany | 417/462 |

*Primary Examiner*—Carl Stuart Miller

*Attorney, Agent, or Firm*—Richard Bushnell

[57] ABSTRACT

A rotary distributor fuel pumping apparatus has a spill valve which is operable to terminate delivery of fuel by a cam actuated pumping plunger. The spill valve is operable by a first piston and a further piston is provided the extent of movement of which is limited by an adjustable stop. A further plunger is actuated in synchronism with the pumping plunger and supplies liquid to the cylinders containing the pistons. When during the inward movement of the plungers, the movement of the further piston is halted the first piston will move to open the spill valve to terminate delivery of fuel.

8 Claims, 1 Drawing Sheet

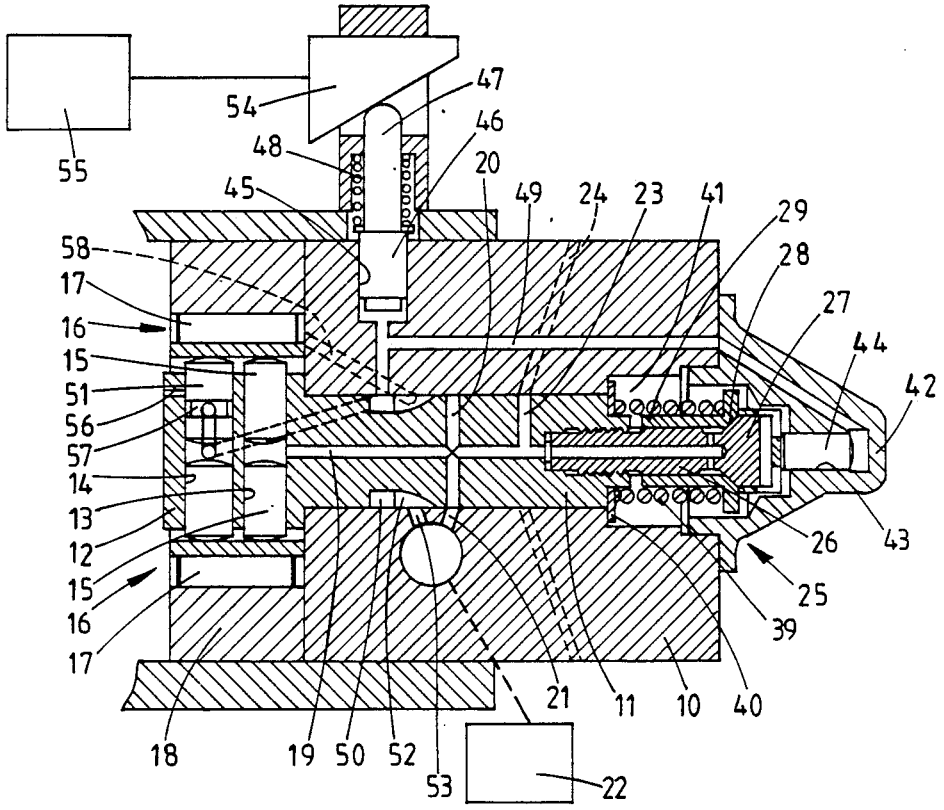
55
54
47
46
48
20
45
49
24
23
41
29
28
27
44
42
58
17
16
15
51
56
57
14
13
12
15
16
17
26
43
25
39
18
19
50
52
53
21
11
10
40
22

FUEL PUMPING APPARATUS

This invention relates to a fuel pumping apparatus for supplying fuel to an internal combustion engine, the apparatus being of the kind including a plunger slidably mounted in a bore, a cam for imparting inward movement to the plunger, an outlet through which fuel can flow during inward movement of the plunger the outlet in use, being connected to a fuel injection nozzle of the associated engine and means for feeding fuel to the bore to effect outward movement of the plunger.

It is known with such an apparatus to provide an adjustable throttle through which fuel is supplied to the bore from a source of fuel under pressure The setting of the throttle determines the amount of fuel supplied to the bore and hence the amount of fuel which is supplied through the outlet to the associated engine when the plunger is moved inwardly by the cam. With this arrangement the timing of the start of fuel delivery to the engine depends on the amount of fuel which is supplied to the engine and the smaller the quantity of fuel the later the start of fuel delivery. This variation in timing has to be compensated for by other means for example by effecting adjustment of the cam. Moreover, the pressure of fuel is high as the plunger or its follower, rides over the crest of the cam leading to substantial stress in the material forming the cam lobe and the follower. The latter difficulty can be overcome by arranging for spillage of fuel to occur at a predetermined position during the inward movement of the plunger and before the plunger or its follower moves over the crest of the cam lobe.

An alternative approach is to arrange for the bore to be completely filled with fuel and to spill a portion of the fuel expelled from the bore during the inward movement of the plunger By arranging that spillage of fuel takes place in the latter portion of the inward movement of the plunger the timing of the start of fuel delivery remains constant and the fuel pressure in the bore is relieved before the plunger or its follower, moves over the crest of the cam lobe.

It is known to control the spillage of fuel by means of an electro-magnetically controlled valve. Such an arrangement, however, requires the provision of a position sensor and the associated control circuit to ensure that the valve is operated at the correct time in the cycle of operation of the plunger Alternatively the spillage of fuel may be effected using a so called spill muff which surrounds the plunger or a rotary member mounting the plunger and which with the plunger or rotary member defines a spill path which is opened at a predetermined position during the inward movement of the plunger. The aforesaid position can be varied to enable the amount of fuel supplied to the engine to be controlled.

For various reasons the proposals outlined above are not entirely satisfactory and the object of the present invention is to provide an apparatus of the kind specified in an improved form According to the invention an apparatus of the kind specified comprises a spill path from said bore, a spill valve in said spill path said spill valve including a spill valve member which is spring biased to the closed position, a first piston slidable within a first cylinder, said first piston when the fluid pressure in the first cylinder attains a predetermined value moving said spill valve member to the open position, a second piston slidable in a second cylinder, said first and second cylinders communicating with each other, spring means biasing said second piston against the action of the fluid pressure in said cylinders, adjustable stop means for limiting the movement of said second piston against the action of said spring means and a further plunger operable in synchronism with said first mentioned plunger, said further plunger being slidable in a further bore which is in communication with said cylinders, the arrangement being such that during the inward movement of the plungers the first mentioned plunger will deliver fuel to the outlet and the further plunger will deliver fluid to said cylinders, the fluid displaced by said further plunger being initially absorbed by movement of said second piston until its movement is halted by said stop means whereupon the fluid pressure in said first cylinder increases to at least said predetermined value and the spill valve is moved to the open position to terminate delivery of fuel through said outlet.

An example of a fuel pumping apparatus in accordance with the invention will now be described with reference to the accompanying drawing Referring to the drawing the apparatus comprises a multi part body 10 in which is housed a rotary cylindrical distributor member 11, the distributor member being coupled to a drive shaft (not shown) which is connected to and therefore rotates in synchronism with the associated engine The distributor member has an enlarged portion 12 in which is formed a pair of diametrically disposed bores 13, 14. The bore 13 mounts a pair of pumping plungers 15 which at their outer ends engage cam followers 16 each of the cam followers having a roller 17 which engages the internal peripheral service of an annular cam ring 18 mounted within the body part. The cam ring has on its internal peripheral surface four equi-angularly spaced cam lobes. The space defined between the plungers 15 communicates with a longitudinally extending passage 19 formed in the distributor member and which communicates with in the particular example, four equi-angularly spaced and radially extending inlet passages 20. The passages 20 can register in turn and as the distributor member rotates, with an inlet port 21 formed in the body part and in constant communication with a low pressure fuel supply pump 22.

The passage 19 also communicates with a delivery passage 23 which extends to the periphery of the distributor member and is positioned to communicate in turn as the distributor member rotates, with four equi-angularly spaced outlets 24 which in use communicate with the injection nozzles respectively of the associated engine.

The items thus far described form the essential components of a distributor type fuel injection pump and when an inlet passage 20 communicates with the inlet port 21, fuel is supplied to the bore 13 to effect outward movement of the plungers 15 in this case to their maximum extent as permitted by the contour of the cam ring 18. As the distributor member rotates the inlet passage 20 moves out of register with the inlet port 21 and the delivery passage 23 moves into register with an outlet 24 so that as the plungers 15 are moved inwardly by the cam lobes the fuel contained in the bore 13 will be displaced to the associated engine.

In order to control the quantity of fuel supplied by the apparatus there is provided a spill valve which is generally indicated at 25. The spill valve comprises a body member 26 which is in the example, in screw thread engagement with the distributor member. The body member defines a head 27 on the underside of which is formed a frusto conical seating 28 and adjacent the head the body member is provided with a circumferential groove which by means of an axially extending passage in the body member, is in constant communication with the passage 19 in the distributor member. Slidable about the spill valve body member is a spill valve member 29 which is of hollow cylindrical form having an outwardly extending flange and shaped for engagement with the seating. The flange is engaged by one end of a coiled compression spring 39 the other end of which bears against an annular abutment 40 which is located against a step formed on the periphery of the distributor member the abutment 40 extends outwardly beyond the distributor member and also engages a step defined in a recess 41 defined in the body.

The open end of the recess is closed by a closure member 42 in which is formed a cylinder 43. Slidably mounted in the cylinder is a first piston 44 which when fluid under pressure is supplied to the cylinder, is urged towards the head 27 of the spill valve. A stirrup is interposed between the piston 44 and the spill valve member 29, the stirrup being slidable about the circumferential surface of the head 27. In use, when the pressure in the cylinder 43 attains a predetermined value, the spill valve member will be moved axially against the action of the spring 39 to permit spillage of fuel from the passage 19 into the recess 41, the recess 41 communicating with a drain or the inlet of the low pressure pump 22.

A further cylinder 45 is defined in the body part the cylinder 45 containing a second piston 46 which has an extension 47. The piston 46 is biased towards the closed end of the cylinder by means of a coiled compression spring 48 and the two cylinders 45 and 43 are in communication with each other by way of a passage 49 formed in the body part and the end closure member 42.

The passage 49 communicates with a circumferential groove 50 formed on the periphery of the distributor member and the groove 50 is in constant communication with the intermediate portion of the bore 14. Located in the bore 14 are a further pair of plungers 51 which at their outer ends engage the followers 16 respectively.

Communicating with the circumferential groove 50 are four equi-angularly spaced longitudinal grooves 52 which are positioned to register with a supply port 53 formed in the body part and communicating with the low pressure supply pump 22. The grooves 52 are positioned to register with the supply port 53 at the same time that the inlet passages 20 register with the inlet port 21.

The extension 47 of the piston 46 is engageable with a stop means which in the example is shown as a wedge member 54 and the wedge member can be moved to vary the extent of allowed outward movement of the piston 46, by a governor system 55. In operation, when the plungers 51 are moved inwardly, the fuel displaced from the bore 14 is supplied to the cylinders 43 and 45. The strength of the spring 39 and the area of the piston 44 are such in relation to the strength of the spring 48 and the area of the piston 46, that the piston 46 moves outwardly in preference to movement of the piston 44. The initial volume of fluid in this case fuel, displaced by the plungers 51 is absorbed by outward movement of the piston 46 and only when the extension 47 engages the wedge member 54 does the pressure in the cylinders rise to the extent that movement of the piston 44 occurs to displace the spill valve member against the action of its spring. The plungers 15 and 51 are moved inwardly at the same time and hence so long as the piston 46 is moving outwardly, fuel will be delivered to the associated engine. When the movement of the piston 46 is halted the spill valve member is lifted from the seating 28 and the further quantity of fuel delivered by the plungers 15 is spilled into the recess 41. When the cam followers move over the crests of the cam lobes, fuel is supplied to the bore 13 as described above and fuel is also supplied to the circumferential groove 50. However, the spill valve member 29 and the piston 46 must be returned to their initial positions before the next inward movement of the plungers take place and therefore the springs 39 and 48 must be sufficiently strong to move the respective pistons against the pressure of fuel developed by the low pressure pump. The fuel which flows through the port 53 is therefore to make up any leakage. It is essential to avoid the presence of any air in the bore 14 and the cylinders 43 and 45 together with the connecting passages. It is therefore proposed to provide a fuel bleed to enable any trapped air to be vented. Two examples are illustrated, the first being a port 56 which is formed in the wall of the bore 14 and which can register with a circumferential groove 57 formed on one of the plungers 51 when the plunger has moved outwardly its maximum extent. The groove 57 communicates with the portion of the bore 14 lying between the plungers When the groove uncovers the port 56 a flow of fuel can take place from the bore 14, the fuel being supplied from the low pressure pump. Instead of providing the port 56 and the groove 57, it is possible to provide a restricted vent passage which is shown in dotted outline at 58 the passage 58 is positioned to communicate with one of the grooves 52 when another one of the grooves is in communication with the supply port 53.

It is essential that the volume of fuel which is displaced by the plungers 51 be capable of being absorbed by movement of the pistons 44 and 46 other wise an hydraulic lock will be created. When the wedge member is set to provide the maximum amount of fuel the piston 46 undergoes its maximum movement and the movement of the piston 44 will only be sufficient to ensure that the spill valve member is lifted from its seating so that the pressure of fuel developed by the plungers 15 is relieved before the followers move over the crests of the cam lobes. When the wedge member is set to provide the minimum flow of fuel to the associated engine, the movement of the piston 46 is substantially less and hence the piston 44 must be capable of moving a sufficient extent to absorb the majority of the fuel displaced by the plungers 51. Movement of the piston 44 requires corresponding movement of the valve member 29 and if it is not possible to provide the required range of movement of the valve member, the bore 43 may be provided with a spill port which is uncovered after a predetermined movement of the piston 44.

The apparatus as described provides a constant start of fuel delivery irrespective of the quantity of fuel supplied to the associated engine and furthermore the fuel pressure intermediate the pumping plungers 15 is relieved before the cam followers move over the crests of the cam lobes. Since advance of the timing of delivery of fuel by the apparatus will be required with increasing engine speed, the cam ring 18 can be moved angularly in the usual manner.

The governor system 55 can be of a mechanical nature or it may be an electronic system with an actuator to position the wedge member and a position sensor to provide a feedback signal to the system.

Using the form of spill valve described a rapid rate of spill can be obtained together with improved sealing. Moreover, the control of the spill valve is effected in a very simple manner.

I claim:

1. A fuel pumping apparatus for supplying fuel to an internal combustion engine, comprising a plunger mounted in a bore, a cam for imparting inward movement to the plunger, an outlet through which fuel can flow during inward movement of the plunger, the outlet being connected in use to a fuel injection nozzle, means for feeding fuel to the bore to effect outward movement of the plunger and a spill valve operable to spill fuel from the bore during inward movement of the plunger to determine the amount of fuel supplied through said outlet characterised in that said spill valve includes a spill valve member which is biased to the closed position, a first piston slidable within a first cylinder, the first piston being operatively connected to said spill valve member whereby when the pressure in the first cylinder attains a predetermined value the spill valve member will be moved to the open position, a second piston slidable in a second cylinder, the first and second cylinders being in communication with each other, spring means biasing said second piston against the action of fluid pressure in said cylinders, adjustable stop means for limiting the movement of said second piston against the action of the spring means, and a further plunger operable in synchronism with said first mentioned plunger a further bore in which said further plunger is mounted, the further bore communicating with said cylinders whereby during inward movement of said plungers the first mentioned plunger will deliver fuel to the outlet and the further plunger will deliver fluid to said cylinders, the fluid displaced by said further plunger being initially absorbed by movement of said second piston until its movement is halted by said stop means whereupon the fluid pressure in said first cylinder increases to at least said predetermined value and the spill valve member is moved to the open position to terminate delivery of fuel through said outlet.

2. An apparatus according to claim 1 characterised by means through which fluid under pressure can be supplied to said further bore and said cylinders during outward movement of the further plunger.

3. An apparatus according to claim 1 or claim 2 characterised in that said spill valve member is in the form of a sleeve slidable about a body member the body member defining a head, the head and the sleeve defining co-operating seating surfaces and the body member defining a groove adjacent the head the groove communicating with said first mentioned bore.

4. An apparatus according to claim 3 characterised by a stirrup slidable about said head said stirrup engaging the first mentioned piston and the sleeve, the sleeve having a flange which is engaged by the spring.

5. An apparatus according to claim 4 including a rotary distributor member in which the bore and the further bore are formed, characterised in that said bore member is mounted on said distributor member in axially disposed relationship.

6. An apparatus according to claim 5 characterised in that said first cylinder is coaxial with the distributor member.

7. An apparatus according to claim 1 characterised in that said further plunger at its outermost position in the further bore opens a vent path from said further bore.

8. An apparatus according to claim 1 characterised by a drain port which is uncovered by said first piston after a predetermined movement of the first piston against the action of the spring.

* * * * *